US011355847B2

(12) United States Patent
Fang et al.

(10) Patent No.: US 11,355,847 B2
(45) Date of Patent: Jun. 7, 2022

(54) ANTENNA STRUCTURE

(71) Applicant: Wistron Corp., New Taipei (TW)

(72) Inventors: Ying-Sheng Fang, New Taipei (TW); Po-Tsang Lin, New Taipei (TW); Shih Ming Chuang, New Taipei (TW); Chia-Wei Su, New Taipei (TW)

(73) Assignee: WISTRON CORP., New Taipei (TW)

( * ) Notice: Subject to any disclaimer, the term of this patent is extended or adjusted under 35 U.S.C. 154(b) by 9 days.

(21) Appl. No.: 16/934,246

(22) Filed: Jul. 21, 2020

(65) Prior Publication Data

US 2021/0399422 A1 Dec. 23, 2021

(30) Foreign Application Priority Data

Jun. 23, 2020 (TW) ..... 109121293

(51) Int. Cl.

| | |
|---|---|
| ***H01Q 5/371*** | (2015.01) |
| ***H01Q 1/38*** | (2006.01) |
| ***H01Q 5/25*** | (2015.01) |
| ***H01Q 9/42*** | (2006.01) |

(52) U.S. Cl.

CPC ..... *H01Q 5/371* (2015.01); *H01Q 1/38* (2013.01); *H01Q 5/25* (2015.01); *H01Q 9/42* (2013.01)

(58) Field of Classification Search

CPC ..... H01Q 1/38; H01Q 5/25; H01Q 5/364; H01Q 5/371; H01Q 9/42

See application file for complete search history.

(56) References Cited

U.S. PATENT DOCUMENTS

| | | | | |
|---|---|---|---|---|
| 9,992,312 | B1 | 6/2018 | Deng et al. | |
| 2012/0194390 | A1 | 8/2012 | Endo et al. | |
| 2012/0313827 | A1* | 12/2012 | Kim | H01Q 1/38 343/702 |
| 2014/0210682 | A1* | 7/2014 | Kao | H01Q 5/371 343/843 |

FOREIGN PATENT DOCUMENTS

TW 201907615 A 2/2019

OTHER PUBLICATIONS

Chinese language office action dated Mar. 16, 2021, issued in application No. TW 109121293.

* cited by examiner

*Primary Examiner* — Robert Karacsony
(74) *Attorney, Agent, or Firm* — McClure, Qualey & Rodack, LLP

(57) ABSTRACT

An antenna structure includes a loop radiation element and a first radiation element. The loop radiation element has a first end and a second end. A feeding point is positioned at the first end of the loop radiation element. A grounding point is positioned at the second end of the loop radiation element. The first radiation element has a first end and a second end. The first end of the first radiation element is coupled to a first connection point on the loop radiation element. The second end of the first radiation element is open. The antenna structure covers a first frequency band and a second frequency band.

12 Claims, 5 Drawing Sheets

ANTENNA STRUCTURE

CROSS REFERENCE TO RELATED APPLICATIONS

This Application claims priority of Taiwan Patent Application No. 109121293 filed on Jun. 23, 2020, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

BRIEF SUMMARY OF THE INVENTION

In an exemplary embodiment, the invention is directed to an antenna structure that includes a loop radiation element and a first radiation element. The loop radiation element has a first end and a second end. A feeding point is positioned at the first end of the loop radiation element. A grounding point is positioned at the second end of the loop radiation element. The first radiation element has a first end and a second end. The first end of the first radiation element is coupled to a first connection point on the loop radiation element. The second end of the first radiation element is open. The antenna structure covers a first frequency band and a second frequency band.

In some embodiments, the antenna structure further includes a dielectric substrate. The loop radiation element and the first radiation element are disposed on the dielectric substrate.

In some embodiments, the dielectric substrate has at least one bending line, such that the antenna structure has a 3D (Three-Dimensional) shape.

In some embodiments, the first frequency band is from 1710 MHz to 2170 MHz.

In some embodiments, the second frequency band includes a first frequency interval from 2496 MHz to 2690 MHz, a second frequency interval from 3300 MHz to 4200 MHz, and a third frequency interval from 4400 MHz to 5000 MHz.

In some embodiments, the length of the loop radiation element is from 0.25 to 0.3 wavelength of the lowest frequency of the first frequency band.

In some embodiments, a slot region is substantially surrounded by the loop radiation element.

In some embodiments, the slot region substantially has a T-shape.

In some embodiments, the loop radiation element includes a first widening portion and a second widening portion. The slot region is positioned between the first widening portion and the second widening portion.

In some embodiments, the first widening portion of the loop radiation element substantially has a rectangular shape.

In some embodiments, the second widening portion of the loop radiation element substantially has a parallelogram shape or a diamond shape.

In some embodiments, the total area of the first widening portion and the second widening portion of the loop radiation element is larger than 60 $mm^2$.

In some embodiments, the slot region substantially has an L-shape.

In some embodiments, the antenna structure further includes a second radiation element having a first end and a second end. The first end of the second radiation element is coupled to a second connection point on the loop radiation element. The second end of the second radiation element is open.

In some embodiments, the first radiation element substantially has a relatively short L-shape, and the second radiation element substantially has a relatively long L-shape.

In some embodiments, the antenna structure further includes a third radiation element having a first end and a second end. The first end of the third radiation element is coupled to a third connection point on the loop radiation element. The second end of the third radiation element is open.

In some embodiments, the antenna structure further includes a fourth radiation element having a first end and a second end. The first end of the fourth radiation element is coupled to a fourth connection point on the loop radiation element. The second end of the fourth radiation element is open.

In some embodiments, the first radiation element and the second radiation element are positioned at the same side of the loop radiation element. The third radiation element and the fourth radiation element are positioned at the opposite side of the loop radiation element.

In some embodiments, the fourth radiation element further includes a terminal bending portion, such that a coupling gap is formed between the third radiation element and the terminal bending portion.

In some embodiments, the distance between the first end and the second end of the loop radiation element is from 0.5 mm to 1.8 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
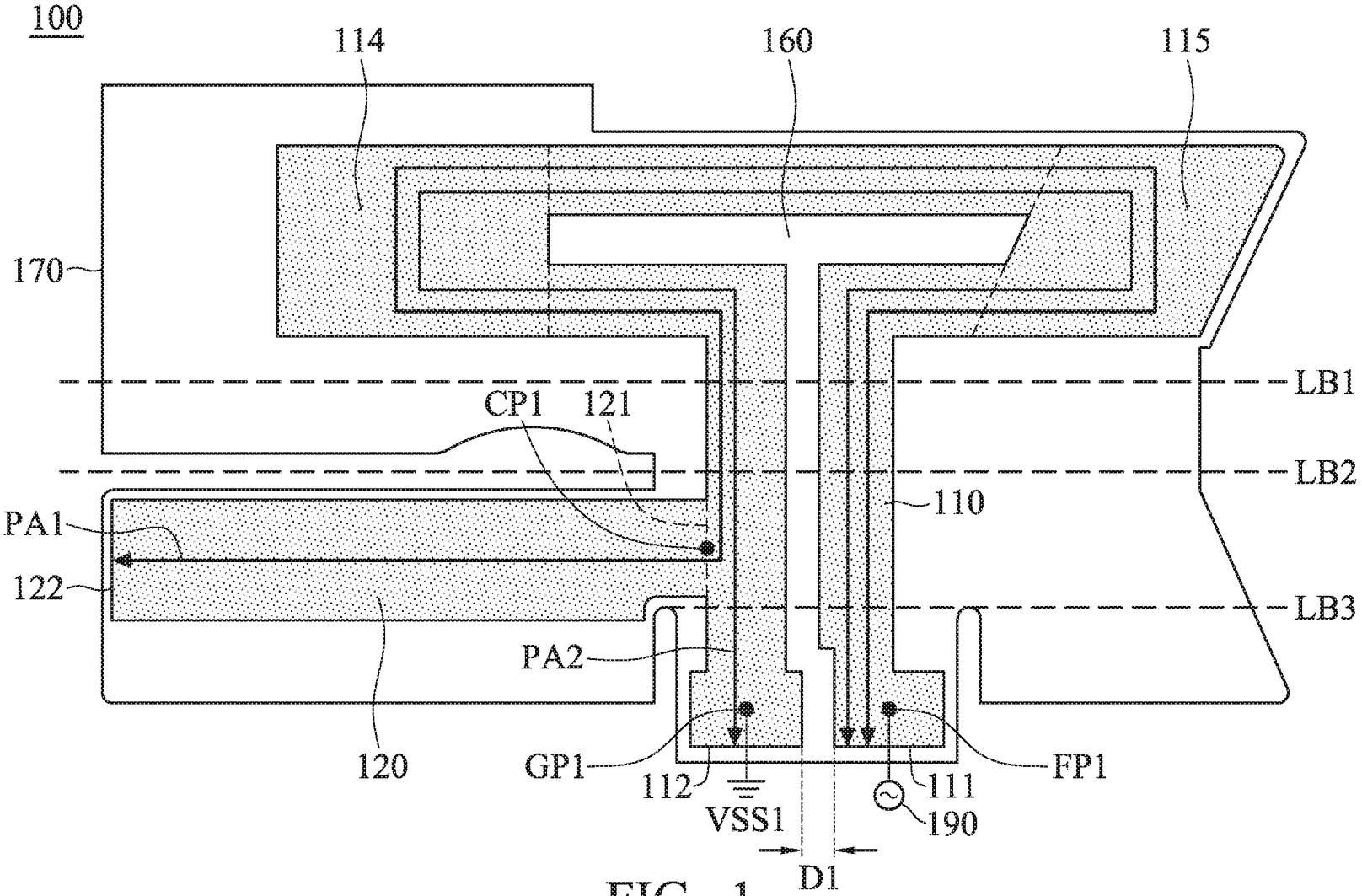
FIG. 1 is a diagram of an antenna structure according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of an antenna structure 100 according to an embodiment of the invention. The antenna structure 100 may be applied to a mobile device, such as a smartphone, a tablet computer, or a notebook computer. As shown in FIG. 1, the antenna structure 100 at least includes a loop radiation element 110 and a first radiation element 120. The loop radiation element 110 and the first radiation element 120 may both be made of metal materials, such as copper, silver, aluminum, iron, or their alloys.

In some embodiments, the antenna structure 100 further includes a dielectric substrate 170. For example, the dielectric substrate 170 may be an FR4 (Flame Retardant 4) substrate, a PCB (Printed Circuit Board), or an FCB (Flexible Circuit Board). The loop radiation element 110 and the first radiation element 120 may form a planar structure, which may be disposed on the same surface of the dielectric substrate 170, but they are not limited thereto. In alternative embodiments, the dielectric substrate 170 has at least one or more bending lines LB1, LB2 and LB3, such that the antenna structure 100 has a 3D (Three-Dimensional) structure. For example, a respective bending angle relative to each of the bending lines LB1, LB2 and LB3 may be from 0 to 90 degrees.

The loop radiation element 110 has a first end 111 and a second end 112. A feeding point FP1 is positioned at the first end 111 of the loop radiation element 110. A grounding point GP1 is positioned at the second end 112 of the loop radiation element 110. The feeding point FP1 may be further coupled to a signal source 190. For example, the signal source 190 may be an RF (Radio Frequency) module for exciting the antenna structure 100. The grounding point GP1 may be further coupled to a ground voltage VSS1, which may be provided by a system ground plane (not shown). In some embodiments, the grounding point GP1 is adjacent to the feeding point FP1. In some embodiments, the grounding point GP1 is connected to the system ground plane via a metal spring. It should be noted that the term "adjacent" or "close" over the disclosure means that the distance (spacing) between two corresponding elements is smaller than a predetermined distance (e.g., 5 mm or shorter), but usually does not mean that the two corresponding elements directly touch each other (i.e., the aforementioned distance/spacing therebetween is reduced to 0).

A slot region 160 is substantially surrounded by the loop radiation element 110. For example, the slot region 160 may substantially have a T-shape, and the loop radiation element 110 may substantially have a hollow T-shape. The loop radiation element 110 may include a first widening portion 114 and a second widening portion 115. The slot region 160 is positioned between the first widening portion 114 and the second widening portion 115. In some embodiments, the first widening portion 114 of the loop radiation element 110 may substantially have a rectangular shape, and the second widening portion 115 of the loop radiation element 110 may substantially have a parallelogram shape or a diamond shape, but they are not limited thereto.

The first radiation element 120 may substantially have a straight-line shape, which may be at least partially perpendicular to the loop radiation element 110. Specifically, the first radiation element 120 has a first end 121 and a second end 122. The first end 121 of the first radiation element 120 is coupled to a first connection point CP1 on the loop radiation element 110. The second end 122 of the first radiation element 120 is an open end, which may extend away from the loop radiation element 110.

Figure 2:
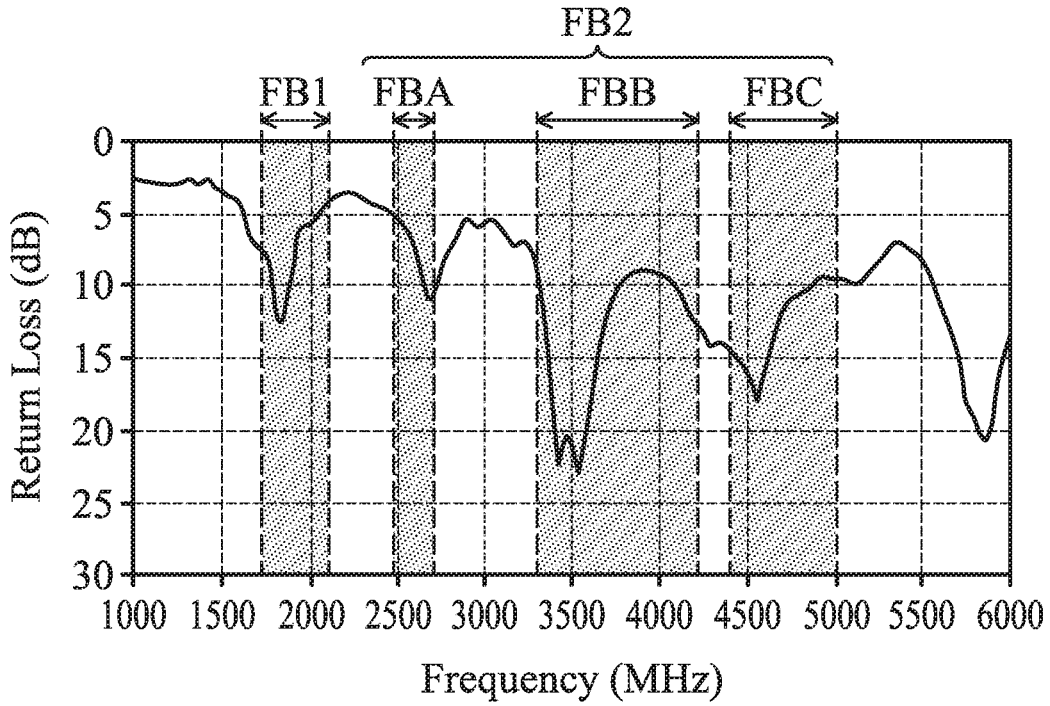
FIG. 2 is a diagram of return loss of an antenna structure according to an embodiment of the invention.

FIG. 2 is a diagram of return loss of the antenna structure 100 according to an embodiment of the invention. The horizontal axis represents the operation frequency (MHz), and the vertical axis represents the return loss (dB). According to the measurement of FIG. 2, when being excited by the signal source 190, the antenna structure 100 can cover a first frequency band FB1 and a second frequency band FB2. For example, the first frequency band FB1 may be from 1710 MHz to 2170 MHz. The second frequency band FB2 may include a first frequency interval FBA from 2496 MHz to 2690 MHz, a second frequency interval FBB from 3300 MHz to 4200 MHz, and a third frequency interval FBC from 4400 MHz to 5000 MHz. Accordingly, the antenna structure 100 can support at least the wideband operations of LTE (Long Term Evolution) and sub-6 GHz bands of the next generation of 5G communication.

Figure 3:
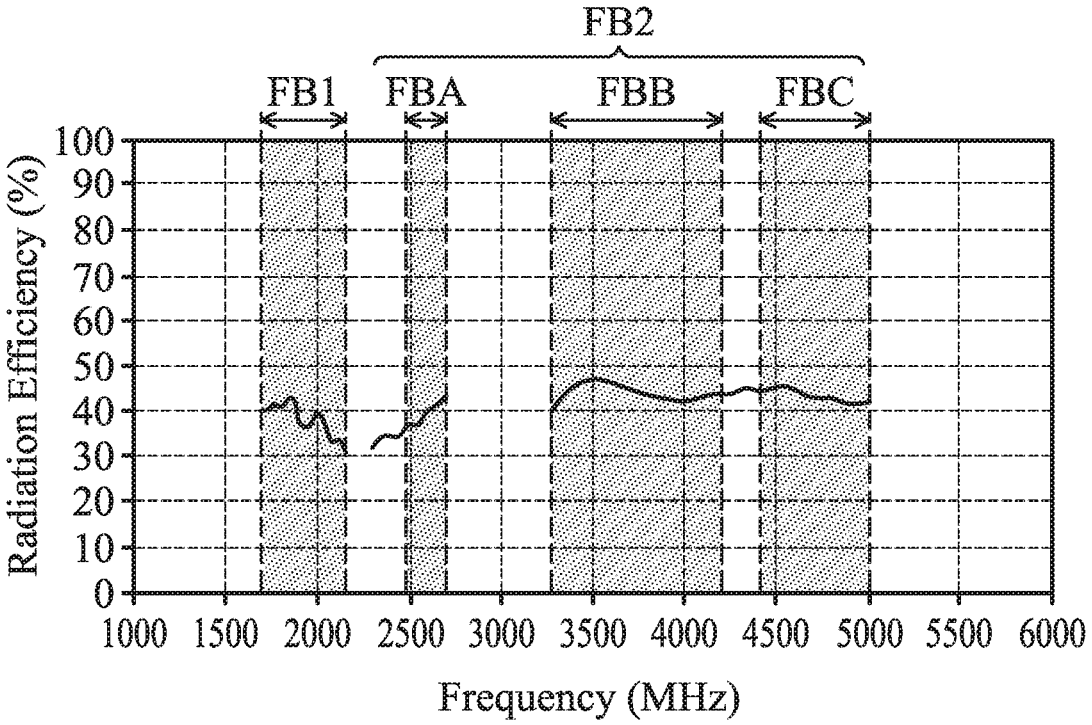
FIG. 3 is a diagram of radiation efficiency of an antenna structure according to an embodiment of the invention.

FIG. 3 is a diagram of radiation efficiency of the antenna structure 100 according to an embodiment of the invention. The horizontal axis represents the operation frequency (MHz), and the vertical axis represents the radiation efficiency (%). According to the measurement of FIG. 3, the radiation efficiency of the antenna structure 100 can be higher than 30% within both of the first frequency band FB1 and the second frequency band FB2, and it can meet the requirement of practical application of general mobile communication devices.

In some embodiments, the operation principles of the antenna structure 100 may be described as follows. A first resonant path PA1 is formed from the feeding point FP1 through the loop radiation element 110 and the first connection point CP1 to the second end 122 of the first radiation element 120, and it can be excited to generate the first frequency band FB1. A second resonant path PA2 is formed from the feeding point FP1 through the loop radiation element 110 to the grounding point GP1, and it can be excited to generate the first frequency interval FBA. The first radiation element 120 can be excited to generate the second frequency interval FBB. The first widening portion 114 and the second widening portion 115 of the loop radiation element 110 can be excited to generate the third frequency interval FBC. According to practical measurements, if the total area of the first widening portion 114 and the second widening portion 115 of the loop radiation element 110 is designed to be larger than 60 $mm^2$, the antenna structure 100 will have good impedance matching within the third frequency interval FBC.

In some embodiments, the element sizes of the antenna structure 100 are described as follows. The length of the first resonant path PA1 may be from 0.31 to 0.33 wavelength (0.31λ~0.33λ) of the first frequency band FB1 of the antenna structure 100. The length of the second resonant path PA2 may be from 0.37 to 0.39 wavelength (0.37λ~0.39λ) of the first frequency interval FBA of the antenna structure 100. The length of the loop radiation element 110 (i.e., the length from the first end 111 to the second end 112, which may be similar to the length of the second resonant path PA2) may be from 0.25 to 0.3 wavelength (0.25λ~0.3λ) of the lowest frequency of the first frequency band FB1 of the antenna structure 100. The distance D1 between the first end 111 and the second end 112 of the loop radiation element 110 may be from 0.5 mm to 1.8 mm. The above ranges of element sizes are calculated and obtained according to many experiment results, and they help to optimize the operation bandwidth and impedance matching of the antenna structure 100.

Figure 4:
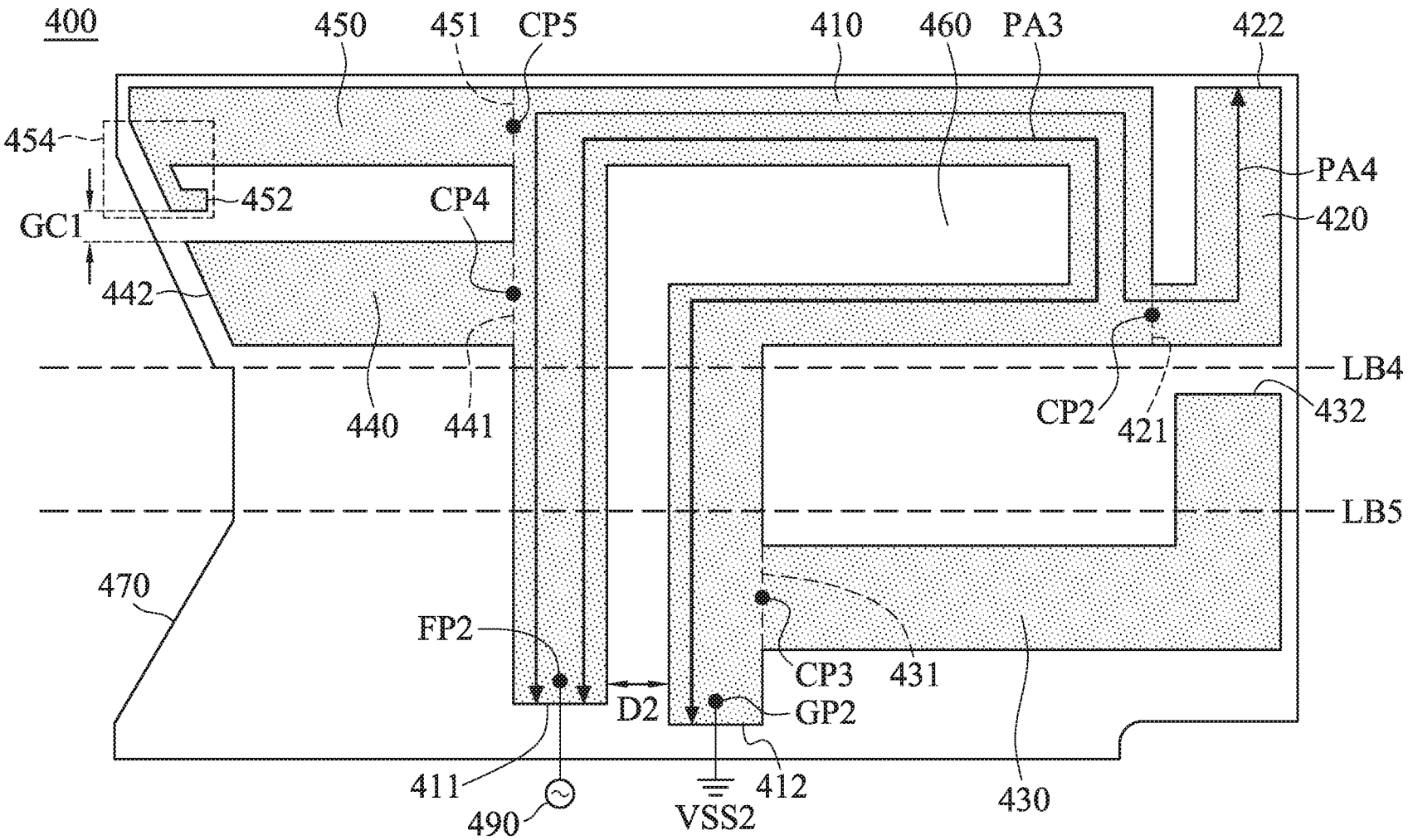
FIG. 4 is a diagram of an antenna structure according to another embodiment of the invention.

FIG. 4 is a diagram of an antenna structure 400 according to another embodiment of the invention. In the embodiment of FIG. 4, the antenna structure 400 includes a loop radiation element 410, a first radiation element 420, a second radiation element 430, a third radiation element 440, and a fourth radiation element 450. The loop radiation element 410, the first radiation element 420, the second radiation element 430, the third radiation element 440, and the fourth radiation element 450 may all be made of metal materials.

In some embodiments, the antenna structure 400 further includes a dielectric substrate 470. For example, the dielectric substrate 470 may be an FR4 substrate, a PCB, or an FCB. The loop radiation element 410, the first radiation element 420, the second radiation element 430, the third radiation element 440, and the fourth radiation element 450 may form a planar structure, which may be disposed on the same surface of the dielectric substrate 470. In alternative embodiments, the dielectric substrate 470 has at least one or more bending lines LB4 and FB5, such that the antenna structure 400 has a 3D structure. For example, a respective bending angle relative to each of the bending lines LB4 and FB5 may be from 0 to 90 degrees.

The loop radiation element 410 has a first end 411 and a second end 412. A feeding point FP2 is positioned at the first end 411 of the loop radiation element 410. A grounding point GP2 is positioned at the second end 412 of the loop radiation element 410. The feeding point FP2 may be further coupled to a signal source 490. The grounding point GP2 may be further coupled to a ground voltage VSS2. In some embodiments, the grounding point GP2 is adjacent to the feeding point FP2. In some embodiments, the grounding point GP2 is connected to a metal module via a conductive adhesive, and the grounding point GP2 is further connected to the system ground plane via the metal module. A slot region 460 is substantially surrounded by the loop radiation element 410. For example, the slot region 460 may substantially have a variable-width L-shape, and the loop radiation element 410 may substantially have a hollow L-shape.

The first radiation element 420 may substantially have a relatively short L-shape. Specifically, the first radiation element 420 has a first end 421 and a second end 422. The first end 421 of the first radiation element 420 is coupled to a first connection point CP2 on the loop radiation element 410. The second end 422 of the first radiation element 420 is an open end.

The second radiation element 430 may substantially have a relatively long L-shape. Specifically, the second radiation element 430 has a first end 431 and a second end 432. The first end 431 of the second radiation element 430 is coupled to a second connection point CP3 on the loop radiation element 410. The second end 432 of the second radiation element 430 is an open end. The second end 432 of the second radiation element 430 and the second end 422 of the first radiation element 420 may substantially extend in the same direction.

The third radiation element 440 may substantially have a straight-line shape, which may be at least partially perpendicular to the loop radiation element 410. Specifically, the third radiation element 440 has a first end 441 and a second end 442. The first end 441 of the third radiation element 440 is coupled to a third connection point CP4 on the loop radiation element 410. The second end 442 of the third radiation element 440 is an open end, which may extend away from the loop radiation element 410.

The fourth radiation element 450 may substantially have a straight-line shape or an inverted J-shape, which may be at least partially perpendicular to the loop radiation element 410, and may also be at least partially parallel to the third radiation element 440. Specifically, the fourth radiation element 450 has a first end 451 and a second end 452. The first end 451 of the fourth radiation element 450 is coupled to a fourth connection point CP5 on the loop radiation element 410. The second end 452 of the fourth radiation element 450 is an open end. In some embodiments, the fourth radiation element 450 further includes a terminal bending portion 454 adjacent to its second end 452, such that a coupling gap GC1 is formed between the third radiation element 440 and the terminal bending portion 454 of the fourth radiation element 450. It should be noted that the first radiation element 420 and the second radiation element 430 are positioned at the same side (e.g., the right side) of the loop radiation element 410, and the third radiation element 440 and the fourth radiation element 450 are positioned at the opposite side (e.g., the left side) of the loop radiation element 410.

Figure 5:
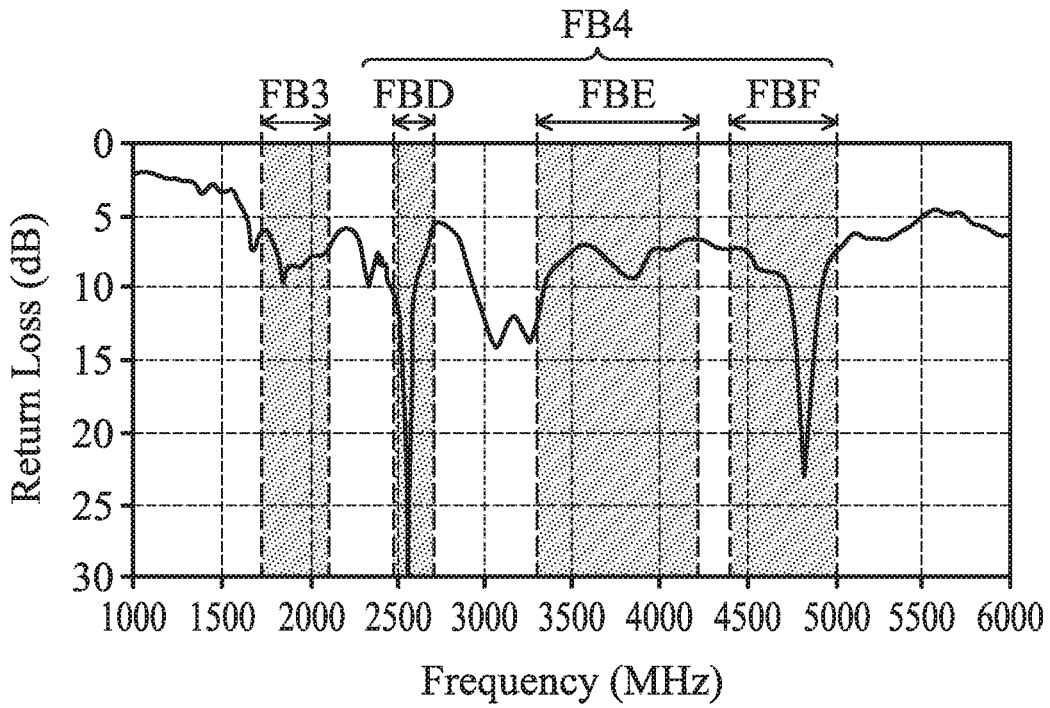
FIG. 5 is a diagram of return loss of an antenna structure according to another embodiment of the invention.

FIG. 5 is a diagram of return loss of the antenna structure 400 according to another embodiment of the invention. The horizontal axis represents the operation frequency (MHz), and the vertical axis represents the return loss (dB). According to the measurement of FIG. 5, when being excited by the signal source 490, the antenna structure 400 can cover a first frequency band FB3 and a second frequency band FB4. For example, the first frequency band FB3 may be from 1710 MHz to 2170 MHz. The second frequency band FB4 may include a first frequency interval FBD from 2496 MHz to 2690 MHz, a second frequency interval FBE from 3300 MHz to 4200 MHz, and a third frequency interval FBF from 4400 MHz to 5000 MHz. Accordingly, the antenna structure 400 can support at least the wideband operations of LTE and sub-6 GHz bands of the next generation of 5G communication.

Figure 6:
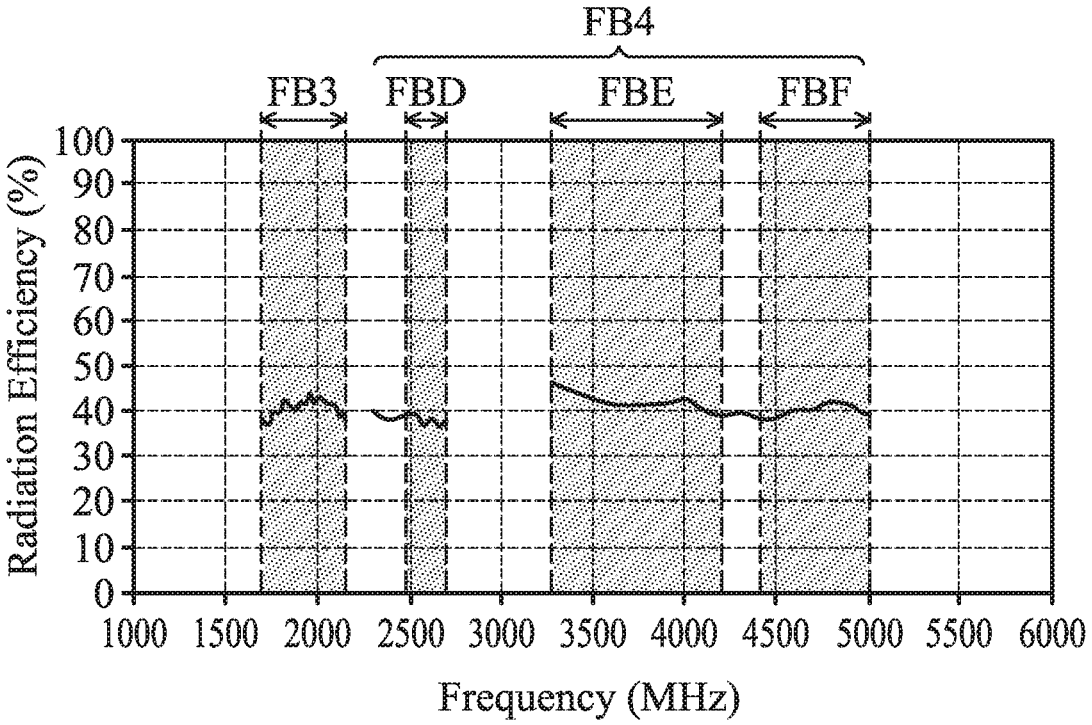
FIG. 6 is a diagram of radiation efficiency of an antenna structure according to another embodiment of the invention.

FIG. 6 is a diagram of radiation efficiency of the antenna structure 400 according to another embodiment of the invention. The horizontal axis represents the operation frequency (MHz), and the vertical axis represents the radiation efficiency (%). According to the measurement of FIG. 6, the radiation efficiency of the antenna structure 400 can be higher than 30% within both of the first frequency band FB3 and the second frequency band FB4, and it can meet the requirement of practical application of general mobile communication devices.

In some embodiments, the operation principles of the antenna structure 400 may be described as follows. A first resonant path PA3 is formed from the feeding point FP2 through the loop radiation element 410 to the grounding point GP2, and it can be excited to generate the first frequency band FB3. A second resonant path PA4 is formed from the feeding point FP2 through the loop radiation element 410 and the first connection point CP2 to the second end 422 of the first radiation element 420, and it can be excited to generate the first frequency interval FBD. The second radiation element 430 can be excited to generate the second frequency interval FBE. The third radiation element 440 and the fourth radiation element 450 can be excited to generate the third frequency interval FBF. According to practical measurements, if the terminal bending portion 454 of the fourth radiation element 450 is added and adjacent to the third radiation element 440, the coupling gap GC1 therebetween can help to improve the impedance matching of the antenna structure 400 within the third frequency interval FBF.

In some embodiments, the element sizes of the antenna structure 400 are described as follows. The length of the first resonant path PA3 may be from 0.27 to 0.29 wavelength (0.27λ~0.29λ) of the first frequency band FB3 of the antenna structure 400. The length of the second resonant path PA4 may be from 0.29 to 0.31 wavelength (0.29λ~0.31λ) of the first frequency interval FBD of the antenna structure 400. The length of the loop radiation element 410 (i.e., the length from the first end 411 to the second end 412, which may be similar to the length of the first resonant path PA3) may be from 0.25 to 0.3 wavelength (0.25λ~0.3λ) of the lowest frequency of the first frequency band FB3 of the antenna structure 400. The distance D2 between the first end 411 and the second end 412 of the loop radiation element 410 may be from 0.5 mm to 1.8 mm. The width of the coupling gap GC1 may be from 0.9 mm to 1.1 mm. The above ranges of element sizes are calculated and obtained according to many experiment results, and they help to optimize the operation bandwidth and impedance matching of the antenna structure 400.

Figure 7:
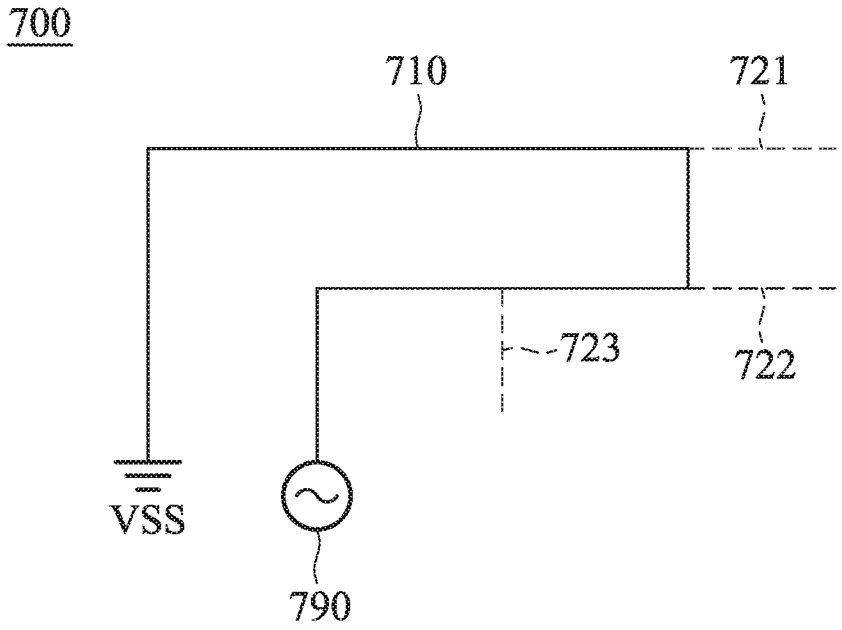
FIG. 7 is a diagram of an antenna structure according to an embodiment of the invention.

FIG. 7 is a diagram of an antenna structure 700 according to an embodiment of the invention. Generally, the antenna structure 700 includes a loop radiation element 710. An end of the loop radiation element 710 is coupled to a signal source 790, and another end of the loop radiation element 710 is coupled to a ground voltage VSS. The length of the loop radiation element 710 may be from 0.25 to 0.3 wavelength (0.25λ~0.3λ) of the lowest frequency of the antenna structure 700. In addition, the antenna structure 700 further includes one or more radiation elements 721, 722 and 723, which may all be stubs coupled to the loop radiation element 710. The total number of radiation elements 721, 722 and 723 is not limited in the invention. According to practical measurements, these radiation elements 721, 722 and 723 are configured to fine-tune the operation frequency and impedance matching of the antenna structure 700. In some embodiments, the antenna structure 700 is further integrated with other antenna elements, so as to form an MIMO (Multi-Input and Multi-Output) antenna system. Other features of the antenna structure 700 of FIG. 7 are similar to those of the antenna structures 100 and 400 of FIG. 1 and FIG. 4. Accordingly, these embodiments can achieve similar levels of performance.

The invention proposes a novel antenna structure. In comparison to the conventional design, the invention has at least the advantages of small size, wide bandwidth, simple structure, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-7. The invention may include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a loop radiation element, having a first end and a second end, wherein a feeding point is positioned at the first end of the loop radiation element, and a grounding point is positioned at the second end of the loop radiation element; and a first radiation element, having a first end and a second end, wherein the first end of the first radiation element is coupled to a first connection point on the loop radiation element, and the second end of the first radiation element is open;

wherein the antenna structure covers a first frequency band and a second frequency band;

wherein a length of the loop radiation element is from 0.25 to 0.3 wavelength of the lowest frequency of the first frequency band;

wherein the antenna structure further comprises:

a second radiation element, having a first end and a second end, wherein the first end of the second radiation element is coupled to a second connection point on the loop radiation element, and the second end of the second radiation element is open;

wherein the first radiation element substantially has a relatively short L-shape, and the second radiation element substantially has a relatively long L-shape.

2. The antenna structure as claimed in claim 1, further comprising:

a dielectric substrate, wherein the loop radiation element and the first radiation element are disposed on the dielectric substrate.

3. The antenna structure as claimed in claim 2, wherein the dielectric substrate has at least one bending line, such that the antenna structure has a 3D (Three-Dimensional) shape.

4. The antenna structure as claimed in claim 1, wherein the first frequency band is from 1710 MHz to 2170 MHz.

5. The antenna structure as claimed in claim 1, wherein the second frequency band comprises a first frequency interval from 2496 MHz to 2690 MHz, a second frequency interval from 3300 MHz to 4200 MHz, and a third frequency interval from 4400 MHz to 5000 MHz.

6. The antenna structure as claimed in claim 1, wherein a slot region is substantially surrounded by the loop radiation element.

7. The antenna structure as claimed in claim 6, wherein the slot region substantially has an L-shape.

8. The antenna structure as claimed in claim 1, further comprising:

a third radiation element, having a first end and a second end, wherein the first end of the third radiation element is coupled to a third connection point on the loop radiation element, and the second end of the third radiation element is open.

9. The antenna structure as claimed in claim 8, further comprising:

a fourth radiation element, having a first end and a second end, wherein the first end of the fourth radiation element is coupled to a fourth connection point on the loop radiation element, and the second end of the fourth radiation element is open.

10. The antenna structure as claimed in claim 9, wherein the first radiation element and the second radiation element are positioned at a same side of the loop radiation element, and the third radiation element and the fourth radiation element are positioned at an opposite side of the loop radiation element.

11. The antenna structure as claimed in claim 9, wherein the fourth radiation element further comprises a terminal bending portion, such that a coupling gap is formed between the third radiation element and the terminal bending portion.

12. The antenna structure as claimed in claim 1, wherein a distance between the first end and the second end of the loop radiation element is from 0.5 mm to 1.8 mm.

* * * * *